US009044806B2

(12) United States Patent
McCullough et al.

(10) Patent No.: US 9,044,806 B2
(45) **Date of Patent: *Jun. 2, 2015**

(54) MULTI-COMPONENT COMPOSITION METAL INJECTION MOLDING

(71) Applicant: COOL POLYMERS, INC., Concord, NH (US)

(72) Inventors: Kevin A. McCullough, North Kingstown, RI (US); James D. Miller, Roswell, GA (US)

(73) Assignee: COOL POLYMERS, INC., Concord, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/063,629

(22) Filed: Oct. 25, 2013

(65) Prior Publication Data

US 2014/0053999 A1 Feb. 27, 2014

Related U.S. Application Data

(60) Continuation of application No. 13/118,746, filed on May 31, 2011, now Pat. No. 8,591,804, which is a division of application No. 12/561,313, filed on Sep. 17, 2009, now Pat. No. 8,147,585.

(60) Provisional application No. 61/097,570, filed on Sep. 17, 2008.

(51) Int. Cl.

| | |
|---|---|
| ***B22D 17/00*** | (2006.01) |
| ***B22D 17/02*** | (2006.01) |
| ***C22C 18/04*** | (2006.01) |
| ***C22C 21/02*** | (2006.01) |

(52) U.S. Cl.

CPC ..... *B22D 17/00* (2013.01); *B22D 17/02* (2013.01); *C22C 18/04* (2013.01); *C22C 21/02* (2013.01)

(58) Field of Classification Search

CPC ..... B22D 17/00; C22C 21/02
USPC ..... 419/47
See application file for complete search history.

(56) References Cited

U.S. PATENT DOCUMENTS

| | | | |
|---|---|---|---|
| 5,040,589 | A | 8/1991 | Bradley et al. |
| 5,577,546 | A | 11/1996 | Kjar et al. |
| 5,832,982 | A | 11/1998 | Williams et al. |
| 5,879,478 | A | 3/1999 | Loue et al. |
| 5,902,943 | A | 5/1999 | Schaffer et al. |
| 6,003,585 | A | 12/1999 | Williams et al. |
| 6,022,508 | A | 2/2000 | Berns |
| 6,113,667 | A | 9/2000 | Hyogo et al. |
| 6,200,396 | B1 | 3/2001 | Laslaz et al. |
| 6,296,044 | B1 | 10/2001 | Brooks et al. |
| 6,298,901 | B1 | 10/2001 | Sakamoto et al. |
| 6,299,665 | B1 | 10/2001 | LeBeau et al. |
| 6,306,231 | B1 | 10/2001 | Sakamoto et al. |
| 6,321,824 | B1 | 11/2001 | Fink et al. |
| 6,514,308 | B2 | 2/2003 | LeBeau et al. |
| 6,514,309 | B2 | 2/2003 | LeBeau et al. |
| 6,613,123 | B2 | 9/2003 | Corbin et al. |
| 6,648,057 | B2 | 11/2003 | Dworog et al. |
| 6,797,759 | B1 | 9/2004 | Ellison et al. |
| 6,892,790 | B2 | 5/2005 | Czerwinski et al. |
| 6,994,147 | B2 | 2/2006 | Saha et al. |
| 7,028,746 | B2 | 4/2006 | Akers et al. |
| 7,140,419 | B2 | 11/2006 | Doutre et al. |
| 2003/0012677 | A1 | 1/2003 | Senini |
| 2005/0103461 | A1 | 5/2005 | Jorstad et al. |
| 2007/0187006 | A1 | 8/2007 | Chung et al. |
| 2008/0237403 | A1 | 10/2008 | Kelly et al. |
| 2008/0295989 | A1 | 12/2008 | Czerwinski |

FOREIGN PATENT DOCUMENTS

| | | | |
|---|---|---|---|
| EP | 0508858 | B1 | 10/1992 |
| JP | 2004249311 | A | 9/2004 |
| WO | 2009029993 | A1 | 3/2009 |

OTHER PUBLICATIONS

"Screw designs in injection molding" (Technical information published by BASF in 2007; available at http://www.plasticsportalasia.net/wa/plasticsAP~zh_CN/function/conversions:/publish/common/upload/technical_brochures/TI_Screwdesigns.pdf.*

Bottger, B. et al., "Controlling Microstructure in Magnesium Alloys: A Combined Thermodynamic, Experimental and simulation Approach," Advanced Engineering Materials, 2006, vol. 8, No. 4, pp. 241-247.

* cited by examiner

*Primary Examiner* — Jessee Roe
*Assistant Examiner* — Christopher Kessler
(74) *Attorney, Agent, or Firm* — Barlow, Josephs & Holmes, Ltd.

(57) ABSTRACT

A method of metal injection molding on a plastics injection molding machine having a heated barrel with an increasing temperature gradient is disclosed. The method comprises the steps of providing a metal alloy feedstock including a first metal alloy with a first melting point and a second metal alloy with a second melting point that is higher than the first melting point, the first metal alloy and the second metal alloy providing a gradient in composition of solids to liquids paralleling the temperature gradient of the heated barrel, feeding the first metal alloy and the second metal alloy into the plastics injection molding machine, heating the first metal alloy and the second metal alloy within the plastics injection molding machine to about 500-700° F./260-372° C.; and forming an equilibrium of about 5% to about 30% solids to liquids between the first metal alloy and second metal alloy within the heated barrel.

33 Claims, 3 Drawing Sheets

MULTI-COMPONENT COMPOSITION METAL INJECTION MOLDING

CROSS-REFERENCE TO RELATED APPLICATIONS

This patent document is a continuation of U.S. Ser. No. 13/118,746, filed May 31, 2011, now U.S. Pat. No. 8,591,804, which is a division of U.S. Ser. No. 12/561,313, filed on Sep. 17, 2009, now U.S. Pat. No. 8,147,585, which claims priority to earlier filed U.S. Provisional Patent Application Ser. No. 61/097,570, filed on Sep. 17, 2008, the entire contents of which are incorporated herein by reference.

BACKGROUND OF THE INVENTION

1. Field of the Invention

The present invention is related generally to injection molding metals and more particularly to compositions of metals suitable for processing in plastics injection molding machines.

2. Background of the Related Art

Conventional reciprocating screw injection molding machines are capable of processing/molding most commercial polymers and filled or reinforced polymers. Although desirable, the machines have not been able to mold parts from metal alloys. Die casting or other variations on the casting process have been the standard methods to manufacture 3-dimensional, near net shape parts from metal alloys. Thixomolding is one method that uses some of the characteristics of plastic injection molding equipment to mold magnesium alloys. The machine used in thixomolding differs substantially in design and size from the conventional plastic injection molding machine.

It is desirable to process and mold metallic alloys (especially lightweight alloys such as aluminum, zinc and magnesium) on convention plastic injection molding equipment. There is a large installed base of injection molding machinery worldwide and the operating cost of this machinery is significantly less than is required for casting and foundry type operations.

Metallic alloys typically have a relatively narrow temperature transition between the solid and liquid phases. Even the semi-solid phase typically has a narrow temperature window.

Metallic alloys cannot be processed on standard injection molding equipment in the solid phase or in the semi-solid phase above some fraction solid because the machine is not strong enough to overcome the resistance of the solid or semi solid (with high solids content). Similarly standard injection molding equipment is not well suited to process any material with very low viscosity (e.g. water like). Materials with too low of a viscosity have little resistance to force (a requirement in the standard injection molding machine design) and exhibit a flow pattern which is not ideal for filling a mold cavity (results in voids, difficulty in packing out, and poor mechanical properties). That leaves only a narrow range of the semi-solid region (e.g. 5-30 solids) that is typically practical for molding metals on injection molding equipment that requires thermoplastic type flow. This narrow range of the semi-solid region also corresponds to an acceptable viscosity range that enables injection molding.

In a conventional injection molding machine plastic pellets enter the conveying screw at or near room temperature. They are typically heated down the length of the barrel to 450-700° F. (~232-372° C.) depending on the type of plastic and the viscosity desired. The barrel is heated externally to help heat the plastic. The induced shear created by the screw and viscous liquid also accounts for much of the heating of the plastic. Typically barrel temperature is controlled in three zones (front, middle and rear . . . and feed). There is typically only a 100° F. (~37° C.) difference between the front and rear zone temperature set points. However, the material is heated from nearly room temperature to 500-700° F. (~260-372° C.) over the length of the barrel. The feed area temperature is set above room temperature but lower than the temperature that is required to induce melting so that in this section pellets remain solid while being conveyed to the hotter zones. The material is continuously heating due to shear and the residence time in the heated barrel. Therefore, there is a continual gradient in the material temperature down the length of the barrel from RT to the injection temperature (a difference of 400-700° F. (~204-372° C.)). The externally applied barrel heat helps to increase the temperature of the material but is doesn't control the material temperature.

There are other characteristics of the injection molding machine that prohibit precise temperature control in additional to the material temperature gradient down the length of the barrel. Since the screw moves forward and backward there is also potential change in temperature of the material do to its rapid movement up or down the barrel length. New material is constantly being fed and discharged so the heating process is always transient. The molding process is not always running or "on cycle". Downtime for adjustments or problems also changes the temperature profile of the material because the material is typically not moving during these periods. All these factors contribute to not being able to maintain material temperature over a narrow range.

Temperature of the material in process cannot be precisely controlled because of several factors:

a. material is constantly fed and discharged
b. molding is always a transient process (stop/start)
c. material is heated from near room temperature to the injection temperature (e.g. 700° F./372° C.) so there is a temperature gradient in the material down the length of the barrel
d. barrel set point temperatures range only about 100° F./37° C. from front to back . . . but the material must be heated from 70° F./21° C. to e.g. 700° F./372° C. (therefore the barrel set points can influence but not control the material temp)
e. substantial material heat comes from shear forces which are localized at the walls and not uniformly distributed through the material
f. when the machine stops cycling for whatever reason (and material stops being fed/discharge) the heat balance changes All these characteristics make it difficult to maintain a metallic alloy in a processable (narrow) temperature regime. These characteristics are less prohibitive when processing plastics because the processable melt range occurs over a much larger temperature range and the resistance/strength of a cooling plastic is much less than that of metal and is often more easily overcome by the force of the machine/screw.

SUMMARY OF THE INVENTION

The present invention solves the problems of the prior art by providing a multi-component composition with at least a first component with a low melting point and a second component with a higher melting point selected to match with the temperature gradient of a barrel of an plastics injection molding machine. More than two components can be provided. Because of its lower melting point, the first component liquefies first and facilitates the transition of the second component into the liquidus mixture to reduce binding in the injection molding machine. In particular, the first component becomes liquid and its temperature is increased as it moves forward along the length of the barrel by the injection molding machine screw. The second component becomes soluble in the liquid of the first composition. If additional components are used, the additional components become soluble in the first composition also. The additional components are selected to have a melting point greater than the melting point of the first component, but less than the melting point of the second component. The process continues with increasing temperature up to the liquidus temperature of the second component. All this time the composition of the liquid is changing because it has an equilibrium solubility that is temperature dependent. As the composition changes it also has an increasing liquidus temperature. Therefore, the composition is somewhat self-regulating. As the temp increases more of the second (high melting component is soluble). The dissolution of the second component changes the liquid composition and raises its liquidus temperature, thereby requiring even high temperature to incorporate more of the second composition. Similarly, if more than two components are used a similar equilibrium is reached. This means that the near liquid composition steps up at nearly the equilibrium liquidus line with increasing temperature (or length down the barrel of the injection molding machine). As a result, the present invention provides a multi-component composition of metal useable in an injection molding machines to facilitate the molding of metal parts.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

One approach is to define alloys with a wide range between the liquidus and solidus temperatures. This range is still wider than is easily processed. Semi-solids with solid content above about approx. 30-35% are not processable, in general, on conventional injection molding equipment. The range of processability of a semi-solid metal of homogeneous composition is about 5-30 wt % solids. The temperature range to maintain this % solids window is narrow. The temperature window is narrow even in alloys with a wide solidus to liquidus temperature delta.

As an example of the present invention, an alloy with an approximately 130° F. range between liquidus and solidus (85 wt % zinc/15 wt % aluminum) would be a good candidate for injection molding because of relatively large temperature differential. The range of 5-30% solids is significantly lower (approx. 70-80° F.). This material is processable on standard injection molding equipment but the window is not wide enough for acceptable routine processing. The material binds occasionally.

Figure 1:
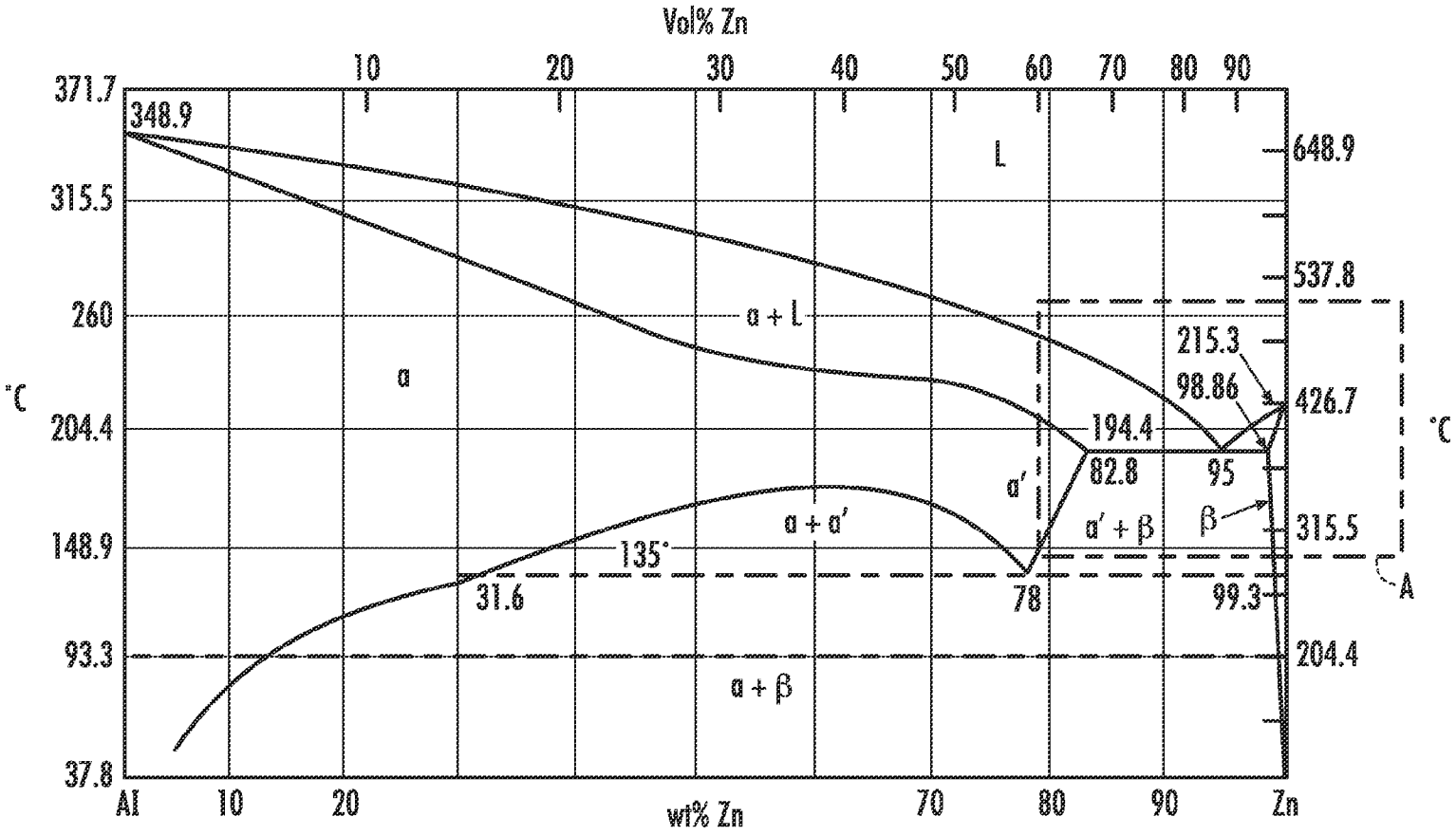
FIG. 1 is a binary phase diagram of a zinc-aluminum metal alloy made in accordance with the method of the present invention.
Figure 2:
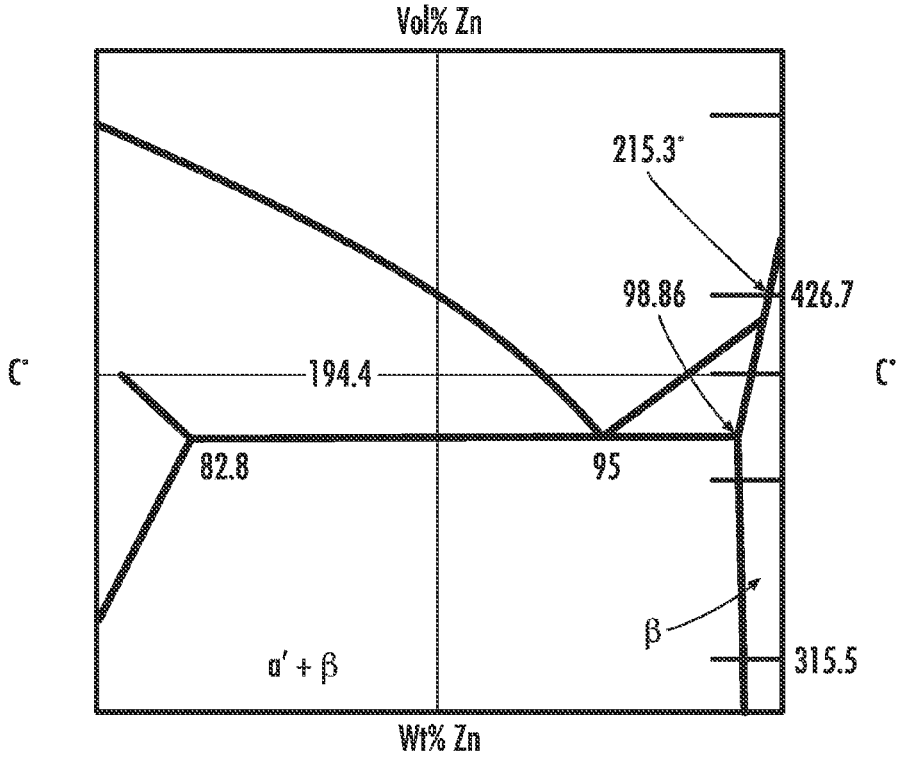
FIG. 2 is a close up view of Inset A of FIG. 1.
Figure 3:
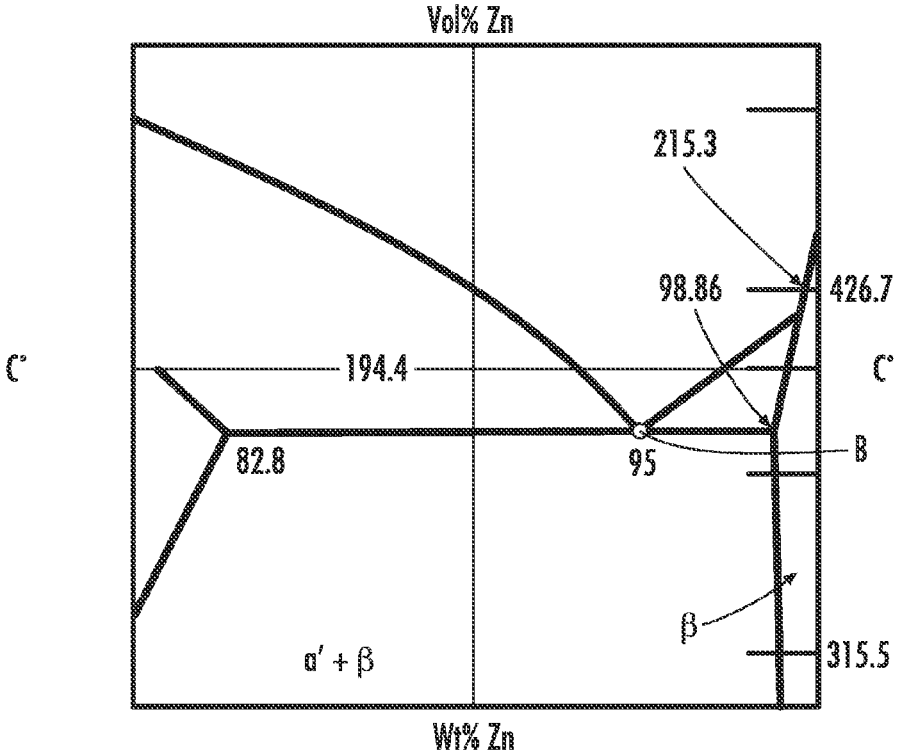
FIG. 3 shows a close up view of Inset A of FIG. 1 with a reference point B indicating the 95 wt % zinc/5 wt % aluminum eutectic.

To view this example in the extreme the Al/Zn eutectic is near 95 wt % Zn/5 wt % Al. Referring to FIG. 3, this composition transforms from solid to liquid without a semi-solid phase. One can imagine that this material is impractical for injection molding. The liquid phase is too low in viscosity for processing (i.e. no resistance to flow and undesirable turbulent flow during mold filling). The solid phase on the other hand will not flow and presents too much resistance to the machine. FIG. 2 is the binary phase diagram for zinc-aluminum in the range 80-100 wt % zinc and between the temperatures of approximately 600 and 900° F.

The invention involves multi-component materials, such as two or more components, that provide a gradient in composition along the length of the barrel that parallels the temperature gradient.

Figure 4:
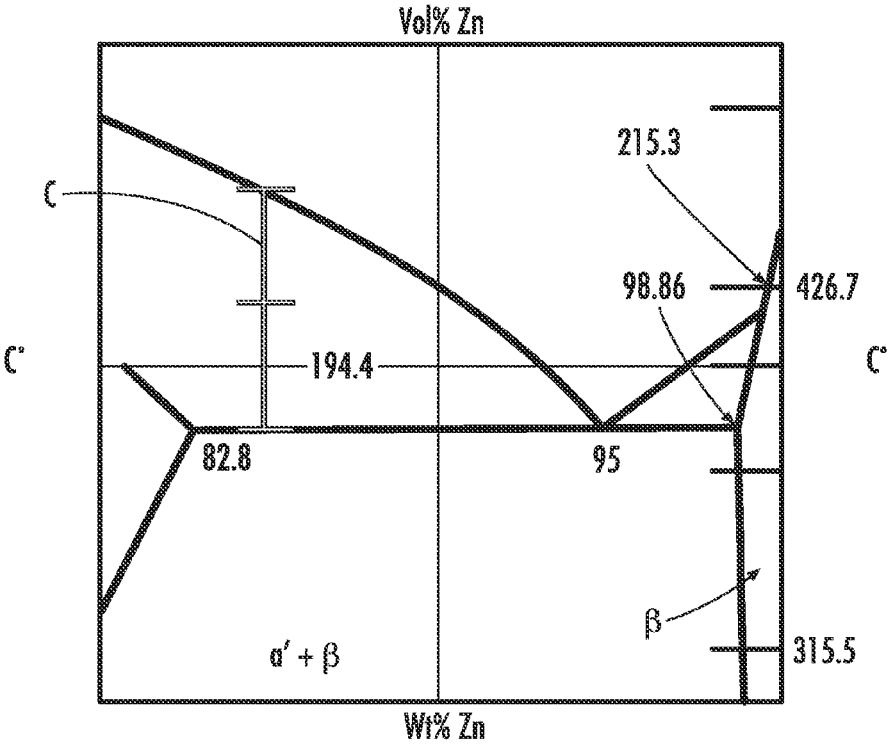
FIG. 4 shows a close up view of Inset A of FIG. 1 with a vertical line with marks C indicating the 85 wt % zinc/15 wt % aluminum singular composition.
Figure 5:
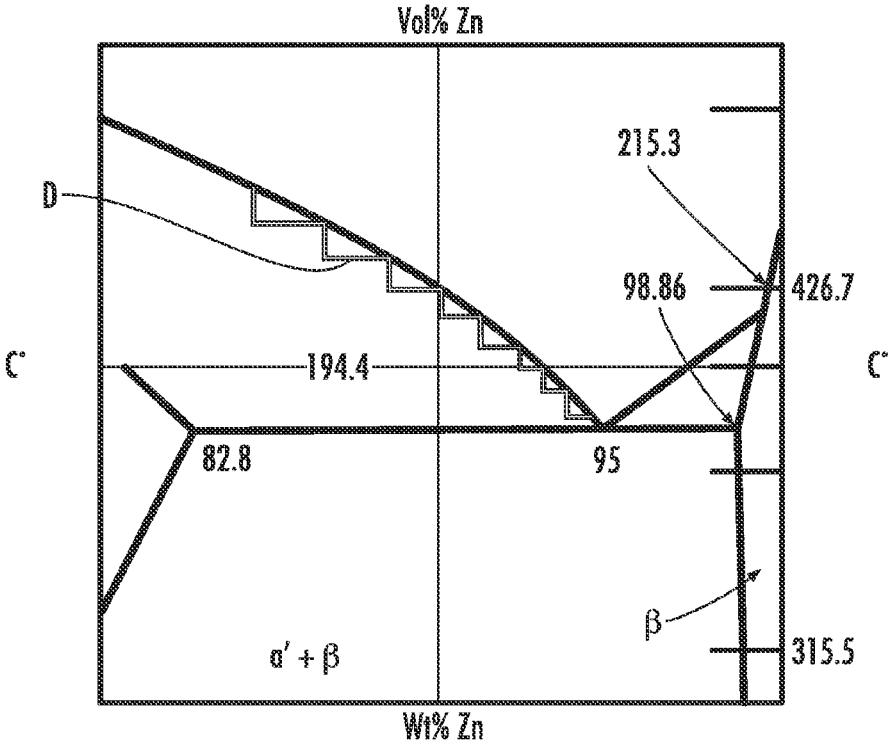
FIG. 5 shows a close up view of Inset A of FIG. 1 with a stepped line D indicating a multi-component composition bounded by 85 wt % zinc/15 wt % aluminum and 95 wt % zinc/5 wt % aluminum.

To describe the invention the phase diagram for Zinc/Aluminum is shown having three different material compositions as seen in FIGS. 3, 4, and 5.

Referring to FIG. 4, a phase diagram is shown for a singular composition of 85 wt % zinc/15 wt % aluminum of the present invention that is processable but without a sufficient window for routine processing. In the phase diagram, it is clear that with this composition the behavior can only extend up and down the vertical line. The range in which it will be processable is in a window that occupies only a portion of this line. Additionally any change in temperature will produce a change in percent solids and therefore a significant change in rheological characteristics.

Referring to FIG. 5, a phase diagram for a multi-component composition bounded by 85 wt % zinc/15 wt % aluminum and 95 wt % zinc/5 wt % aluminum is described. As can be ascertained from FIG. 5, a mixture of soluble compositions results in a compositional gradient that parallels the temperature gradient in the barrel. This mixture ensures that the composition is always reasonably close to the liquidus temperature (low % solids) and will maintain reasonably consistent rheology down the barrel length of an injection molding machine.

An example of the inventions uses a mixture of two aluminum/zinc compositions (mixed pellets having different compositions). In this case both compositions are aluminum-zinc but the ratio of each element is different. A specific example is 95 wt %/5 wt % zinc/aluminum as the first composition and 85 wt %/15 wt % zinc/aluminum as the second composition. The low temperature melting component will form liquid first. As the first component becomes liquid and its temperature is increased as it moves forward along the length of the barrel and components of the second composition become soluble in the liquid. The process continues with increasing temperature up to the liquidus temperature of the second component. All this time the composition of the liquid is changing because it has an equilibrium solubility that is temperature dependent. As the composition changes it also has an increasing liquidus temperature. Therefore, the composition is somewhat self-regulating. As the temp increases more of the second (high melting component is soluble). The dissolution of the second component changes the liquid composition and raises its liquidus temperature, thereby requiring even high temperature to incorporate more of the second composition. This means that the near liquid composition steps up at nearly the equilibrium liquidus line with increasing temperature (or length down the barrel of the injection molding machine).

This process is not reversible so cooling of any given composition does not result in separation of the components. However, because there is a compositional gradient down the length of the barrel any cooling effects (from, for example, movement of the screw) are small relative to the critical temperature at which that particular composition would have too high a solids content to be mechanically moved or sheared by the machine.

This compositional variant provides the necessary window or forgiveness for metal alloys to be processed on conventional injection molding equipment.

The present invention has been shown to produce good molded parts on conventional injection molding equipment (with modification to the screw, i.e. 0 compression, relief of flights in the solid to melt transition area). The examples listed below include two components for simplicity. However, more than two components may be used. The additional components, though, must be selected to have a melting point that falls on the phase change diagram of the alloy between the first component and the second component.

Three specific examples are listed below:

Example 1

10 wt % (+/−5 wt %) (95 wt % zinc/5 wt % aluminum)

90 wt % (+/−5 wt %) (85 wt % zinc/15 wt % aluminum)

More specifically, 15 wt % (95 wt % zinc/5 wt % aluminum) and 85 wt % (85 wt % zinc/15 wt % aluminum) has been found to be optimum.

Example 2

85 wt % (+/−5 wt %) (85 wt % zinc/15 wt % aluminum)

15 wt % (+/−5 wt %) (86 wt % aluminum/10 wt % silicon/4 wt % copper)

More specifically, 88 wt % (85 wt % zinc/15 wt % aluminum) and 12 wt % (86 wt % aluminum/10 wt % silicon/4 wt % copper) has been found to be optimum.

Example 3

50 wt % (85 wt % zinc/15 wt % aluminum)

50 wt % (86 wt % aluminum/10 wt % silicon/4 wt % copper)

In the examples, the first component of 85 wt %/15 wt % zinc/aluminum singular composition or 95/5 wt % zinc/aluminum singular composition is not routinely processable without the second component.

The 86/10/4 wt % Al/Si/Cu singular composition is not routinely processable without the first component.

However, by mixing the two compositions together, the mixed compositions are routinely processable.

Although described here with only three examples the concept is applicable to all metals. There will of course be limitations in regards to maximum temperature reachable in convention injection molding machines and the stability of machine components in presence of hot metallic alloys. Additionally, a non-alloying reinforcement material such as glass, hollow microspheres, fly ash, carbon fiber, mica, clay, silicon carbide, alumina, aluminum oxide fibers or particulates, diamond, boron nitride, or graphite or other reinforcement materials as are known in the art may be added to the feedstock. Additionally, the reinforcement materials may be dry-blended with the feedstock as it is being fed into the injection molding machine to form molded parts and metal-matrix composites.

Therefore, it can be seen that the present invention provides a unique solution to the problem of using a plastics injection molding machine to mold metal parts by using a multi-component composition of two or more components, of metal feedstock with varying composition.

It would be appreciated by those skilled in the art that various changes and modifications can be made to the illustrated embodiments without departing from the spirit of the present invention. All such modifications and changes are intended to be within the scope of the present invention except insofar as limited by the appended claims.

What is claimed is:

1. A method of metal injection molding on a plastics injection molding machine having a heated barrel with an increasing temperature gradient, the method comprising:

providing a metal alloy feedstock including a first metal alloy with a first melting point and a second metal alloy with a second melting point that is higher than the first melting point, the first metal alloy and the second metal alloy providing a gradient in composition of solids to liquids paralleling the temperature gradient of the heated barrel;

wherein the feedstock comprises 5-15 wt % of the first metal alloy comprising 95 wt % zinc/5 wt % aluminum, and 85-95 wt % of the second metal alloy comprising 85 wt % zinc/15 wt % aluminum;

feeding the first metal alloy and the second metal alloy into the plastics injection molding machine;

heating the first metal alloy and the second metal alloy within the plastics injection molding machine to about 500-700° F. (260-572° C.); and forming an equilibrium of about 5% to about 50% solids to liquids between the first metal alloy and second metal alloy within the heated barrel.

2. The method of claim 1, further comprising feeding a non-alloying reinforcing material into the plastics injection molding machine.

3. The method of claim 2, further comprising dry-blending the non-alloying reinforcing material with the metal alloy feedstock.

4. The method of claim 3, wherein the non-alloying reinforcing material comprises glass, hollow microspheres, fly ash, carbon fiber, mica, clay, silicon carbide, alumina, aluminum oxide fibers, aluminum oxide particulates, diamond, boron nitride, or graphite.

5. The method of claim 2, wherein the non-alloying reinforcing material comprises glass, hollow microspheres, fly ash, carbon fiber, mica, clay, silicon carbide, alumina, aluminum oxide fibers, aluminum oxide particulates, diamond, boron nitride, or graphite.

6. The method of claim 1, further comprising modifying the screw of the plastics injection molding machine.

7. The method of claim 6, further comprising relieving of flights on the screw.

8. The method of claim 7, further comprising relieving flights in the solid to melt transition area of the screw.

9. The method of claim 6, further comprising providing a screw with 0 compression.

10. The method of claim 1, further comprising providing a third metal alloy having a melting point between the first melting point and the second melting point.

11. The method of claim 1, further comprising providing a plurality of metal alloys having melting points between the first melting point and the second melting point.

12. A method of metal injection molding on a plastics injection molding machine having a heated barrel with an increasing temperature gradient, the method comprising:

providing a metal alloy feedstock including a first metal alloy with a first melting point and a second metal alloy with a second melting point that is higher than the first melting point, the first metal alloy and the second metal alloy providing a gradient in composition of solids to liquids paralleling the temperature gradient of the heated barrel;

wherein the feedstock comprises 80-90 wt % of the first metal alloy comprising 85 wt % zinc/15 wt % aluminum, and 10-20 wt % of the second metal alloy comprising 86 wt % aluminum/10 wt % silicon/4 wt % copper;

feeding the first metal alloy and the second metal alloy into the plastics injection molding machine;

heating the first metal alloy and the second metal alloy within the plastics injection molding machine to about 500-700° F. (260-572° C.); and forming an equilibrium of about 5% to about 50% solids to liquids between the first metal alloy and second metal alloy within the heated barrel.

13. The method of claim 12, further comprising feeding a non-alloying reinforcing material into the plastics injection molding machine.

14. The method of claim 13, further comprising dry-blending the non-alloying reinforcing material with the metal alloy feedstock.

15. The method of claim 14, wherein the non-alloying reinforcing material comprises glass, hollow microspheres, fly ash, carbon fiber, mica, clay, silicon carbide, alumina, aluminum oxide fibers, aluminum oxide particulates, diamond, boron nitride, or graphite.

16. The method of claim 13, wherein the non-alloying reinforcing material comprises glass, hollow microspheres, fly ash, carbon fiber, mica, clay, silicon carbide, alumina, aluminum oxide fibers, aluminum oxide particulates, diamond, boron nitride, or graphite.

17. The method of claim 12, further comprising modifying the screw of the plastics injection molding machine.

18. The method of claim 17, further comprising relieving of flights on the screw.

19. The method of claim 18, further comprising relieving flights in the solid to melt transition area of the screw.

20. The method of claim 17, further comprising providing a screw with 0 compression.

21. The method of claim 12, further comprising providing a third metal alloy having a melting point between the first melting point and the second melting point.

22. The method of claim 12, further comprising providing a plurality of metal alloys having melting points between the first melting point and the second melting point.

23. A method of metal injection molding on a plastics injection molding machine having a heated barrel with an increasing temperature gradient, the method comprising:

providing a metal alloy feedstock including a first metal alloy with a first melting point and a second metal alloy with a second melting point that is higher than the first melting point, the first metal alloy and the second metal alloy providing a gradient in composition of solids to liquids paralleling the temperature gradient of the heated barrel;

wherein the feedstock comprises 50 wt % of the first metal alloy comprising 85 wt % zinc/15 wt % aluminum, and 50 wt % of the second metal alloy comprising 86 wt % aluminum/10 wt % silicon/4 wt % copper;

feeding the first metal alloy and the second metal alloy into the plastics injection molding machine;

heating the first metal alloy and the second metal alloy within the plastics injection molding machine to about 500-700° F. (260-572° C.); and forming an equilibrium of about 5% to about 50% solids to liquids between the first metal alloy and second metal alloy within the heated barrel.

24. The method of claim 23, further comprising feeding a non-alloying reinforcing material into the plastics injection molding machine.

25. The method of claim 24, further comprising dry-blending the non-alloying reinforcing material with the metal alloy feedstock.

26. The method of claim 25, wherein the non-alloying reinforcing material comprises glass, hollow microspheres, fly ash, carbon fiber, mica, clay, silicon carbide, alumina, aluminum oxide fibers, aluminum oxide particulates, diamond, boron nitride, or graphite.

27. The method of claim 24, wherein the non-alloying reinforcing material comprises glass, hollow microspheres, fly ash, carbon fiber, mica, clay, silicon carbide, alumina, aluminum oxide fibers, aluminum oxide particulates, diamond, boron nitride, or graphite.

28. The method of claim 23, further comprising modifying the screw of the plastics injection molding machine.

29. The method of claim 28, further comprising relieving of flights on the screw.

30. The method of claim 29, further comprising relieving flights in the solid to melt transition area of the screw.

31. The method of claim 28, further comprising providing a screw with 0 compression.

32. The method of claim 23, further comprising providing a third metal alloy having a melting point between the first melting point and the second melting point.

33. The method of claim 23, further comprising providing a plurality of metal alloys having melting points between the first melting point and the second melting point.

* * * * *